US005845681A

United States Patent [19]

Kurmis

[11] Patent Number: 5,845,681

[45] Date of Patent: Dec. 8, 1998

[54] ARRANGEMENT FOR TYING AN ARTICLE, IN PARTICULAR A CABLE HARNESS

[75] Inventor: Viktor Kurmis, Pinneberg, Germany

[73] Assignee: Paul Hellermann GmbH, Pinneberg, Germany

[21] Appl. No.: 948,129

[22] Filed: Oct. 9, 1997

[30] Foreign Application Priority Data

Oct. 10, 1996 [DE] Germany ..... 296 17 651.6

[51] Int. Cl.[6] ..... B21F 9/02

[52] U.S. Cl. ..... 140/93.2; 100/8; 100/30; 140/93 A

[58] Field of Search ..... 100/1, 8, 26, 30, 100/32, 29, 33 R, 33 PB; 140/93.2, 93.4, 93 A, 123.6

[56] References Cited

U.S. PATENT DOCUMENTS

| | | | |
|---|---|---|---|
| 4,004,618 | 1/1977 | Turek | 140/93.2 |
| 4,178,973 | 12/1979 | Collier et al. . | |
| 5,042,535 | 8/1991 | Schlottke | 140/93.2 |
| 5,050,649 | 9/1991 | Kurmis . | |
| 5,205,328 | 4/1993 | Johnson et al. | 140/93.2 |
| 5,351,386 | 10/1994 | Chang . | |
| 5,417,252 | 5/1995 | Kurmis | 140/93.2 |

FOREIGN PATENT DOCUMENTS

| | | |
|---|---|---|
| 0 428 116 | 5/1991 | European Pat. Off. . |
| 0 596 363 | 1/1997 | European Pat. Off. . |
| 2 401 742 | 3/1979 | France . |

*Primary Examiner*—Stephen F. Gerrity
*Attorney, Agent, or Firm*—Alix, Yale & Ristas, LLP

[57] ABSTRACT

An arrangement for tying an article, in particular a cable harness, comprises a tough elastic tape with a closure (12) arranged at the end of an elongated tape tongue and a tying tool. Arranged at the front of the tool body (1) are wrapping tongs (2, 3) that can be opened and closed and through which the tape can be guided around the article to be tied. Located in the tool body is a tape guide channel (10) opening inside the wrapping tongs and having an advancing member for advancing the tape with the tape tongue forward, the channel being adjoined in the wrapping tongs by a tape guide groove (20, 21). Arranged at the mouth of the tape guide channel (10) is a closure holder for holding the closure (12) and a spring rocker (15) for pressing the tape tongue being advanced on to a surface (11) of the tape guide channel (10). According to the invention, the spring rocker (15) has a front face (24) that participates in forming the closure holder (11, 18, 24).

5 Claims, 2 Drawing Sheets

ARRANGEMENT FOR TYING AN ARTICLE, IN PARTICULAR A CABLE HARNESS

BACKGROUND OF THE INVENTION

The invention relates to an arrangement for tying an article, in particular a cable harness, comprising a tape with an elongated tape tongue made of tough elastic plastic and a closure arranged at one end of the tape, as well as a tying tool. In the case of a known tool (EP-A 596 363), there are provided, at the front of the elongated tool body, wrapping tongs that can be opened and closed and which are used for guiding the tape around the article to be tied. Located in the tool body is a tape guide channel having an advancing member for advancing the tape with the tape tongue forward, which channel opens at the tool front inside the wrapping tongs. The said channel is adjoined by a guide groove in the wrapping tongs, which guides the advanced tape around the article to be tied. The width of the tape channel corresponds to the cross-section of the closure, which is significantly thicker than the tape cross-section. The tape is therefore not guided precisely between the walls of the tape channel. However, this guidance is necessary in order that the free end of the said tape passes correctly into the groove of the wrapping tongs. In the case of the known tool, therefore, there is arranged, in the tape guide channel and close to its end, a spring rocker that presses the leading free tape end against a channel wall and as a result imposes on it a guide direction coinciding with the direction of this wall. The said rocker does not impede the passage of the thicker closure, since it can yield in a sprung manner. In order that the free tape end, after passing through the wrapping tongs, passes correctly into the opening of the tape closure, the latter must be held at a defined point. For this purpose, a closure holder is provided at the CD mouth of the tape channel in the wrapping tongs. In the case of the known tool, the closure holder is composed of a stop, which prevents a further movement of the closure, and the advancing member used for advancing the tape, which presses the closure against this stop and consequently determines its position. This design therefore has disadvantages, since the advancing member as such must in turn be guided precisely, which is complicated. The advancing member can also travel back into its initial position only when its retaining function is no longer needed; this leads to a loss of time or to the necessity of a very rapid, wear-sensitive drive.

SUMMARY OF THE INVENTION

The invention is therefore based on the object of providing an arrangement of the type described above which is less complicated and not sensitive.

The solution according to the invention resides in a tying tool of the type described wherein at least one of the wrapping tongs is pivotable toward and away from a closed position and the rocker is mounted on the pivotable wrapping tong in such a manner that the front face of the rocker cooperates with the closure holder.

After the closure has passed the spring rocker, the latter snaps behind the closure into the tape channel, its front face being seated behind the closure and fixing its position in this way. The rocker is arranged such that the closure just has room between a stop acting on its front side and the front face of the spring rocker acting on its rear side. In this arrangement, it is expedient if the rocker is supported at the front side of the tape channel (that is to say, on that side of the tape channel facing the wrapping tongs) at a distance from the closure holder. This applies in particular if the rocker has, adjacent to its front face participating in forming the closure holder, a retaining face that is placed on the closure on the side facing away from the tool body. As a result, the closure is prevented from moving out towards the opening formed inside the wrapping tongs. On the opposite side, corresponding retaining faces may be provided, which prevent moving back.

Since the end of the spring rocker is located directly at the closure in that region in which the free end of the tape is guided towards the closure opening, it is expedient according to the invention if the free end face of the rocker participates in forming the tape guide in the wrapping tongs. For example, in the end region of the guide groove that is provided in the wrapping tongs, adjacent to the closure holder, the said free end face may form its groove bottom.

The said rocker is expediently mounted on the pivotable part of the wrapping tongs. On the one hand, the connection of the rocker front face to the guide groove in the wrapping tongs may be provided more easily. On the other hand, when the tongs are being opened, the rocker is then also pulled back, so that without special control measures its contribution to forming the closure holder is dispensed with, and the closure can be removed freely.

BRIEF DESCRIPTION OF THE DRAWINGS

The invention is explained in more detail below with reference to the drawing, which illustrates an advantageous exemplary embodiment. In the drawing.

DESCRIPTION OF A PREFERRED EMBODIMENT

Figure 1:
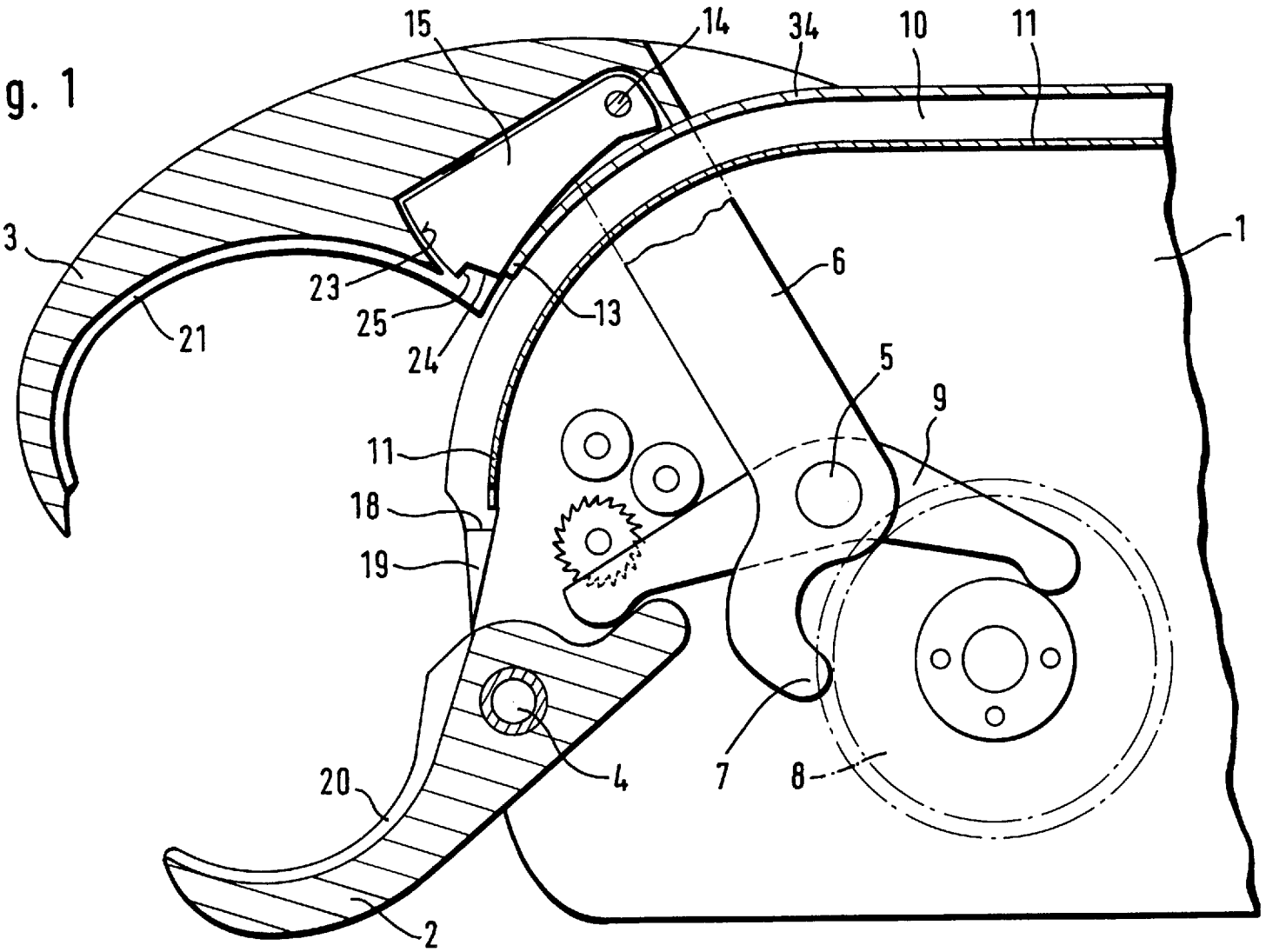
FIG. 1 shows the arrangement with the wrapping tongs open.
Figure 2:
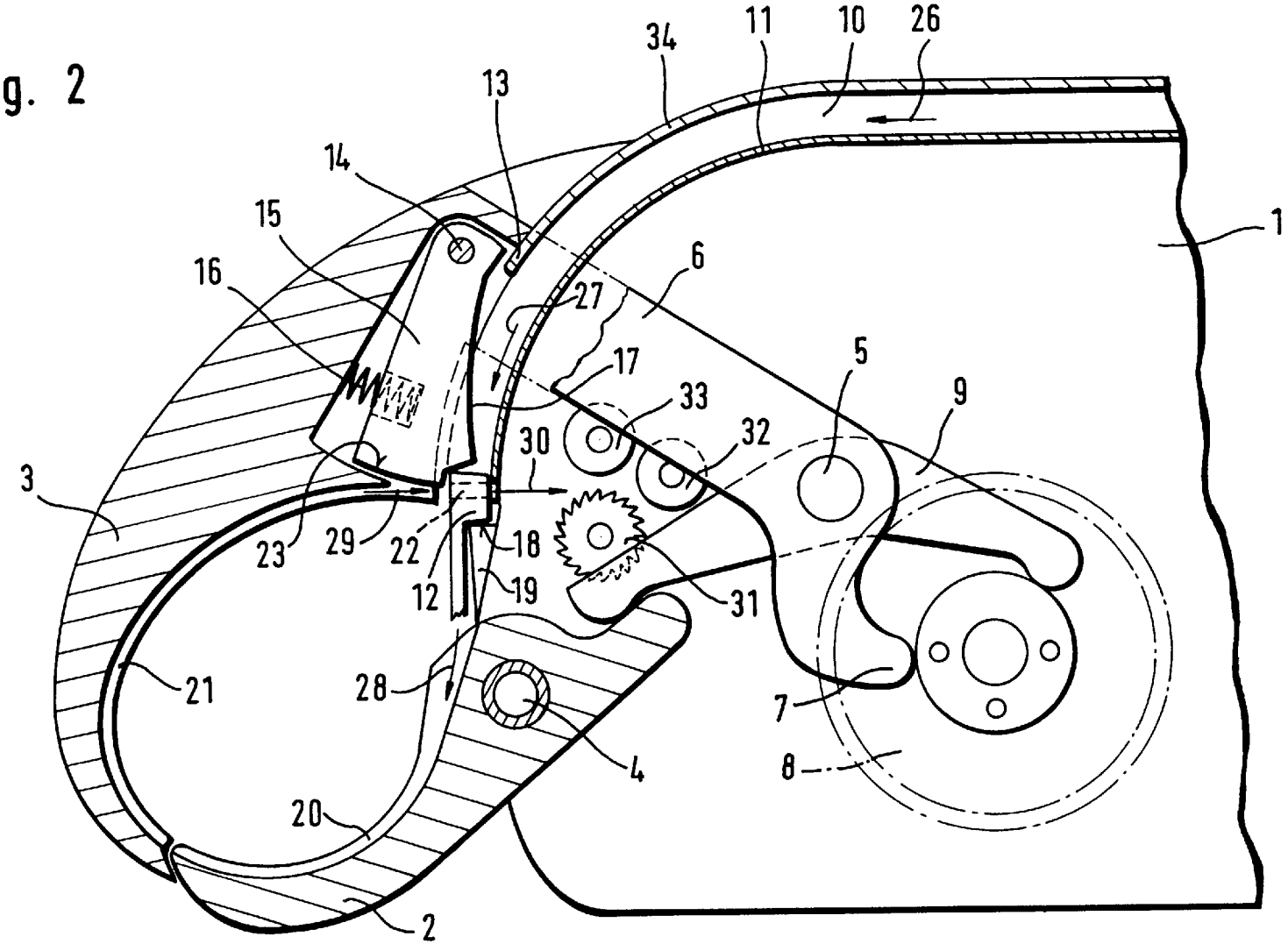
FIG. 2 shows the arrangement with the wrapping tongs closed.

The illustrations show the front part of a tool body 1 of a cable tying tool, from which all those parts not required for an understanding of the function have been left out. Provided at the front of the tool body are wrapping tongs which comprise a lower tongs part 2 and an upper tongs part 3, which can be pivoted about axes 4 and 5 in the tool body. FIG. 1 shows the wrapping tongs in the open position. If an article is intended to be tied, it is introduced into the wrapping tongs and the latter are closed by moving the upper tongs part 3 into the position shown in FIG. 2. The lower tongs part 2 could also participate in the opening and closing function of the tongs by means of an appropriate pivoting movement; however this is not envisaged in the embodiment illustrated. The pivoting movement of the upper tongs part 3, which is guided on an arm 6, is brought about by the interaction of a cam 7 connected to the arm 6 and a cam disc, indicated at 8 without details of the cam guidance. Guiding back is performed by a spring force, not illustrated.

The pivoting movement of the lower tongs part 2 is also caused by the cam disc 8, specifically via the rocker lever 9. The purpose of the pivoting movement of the lower tongs part will be explained later.

Provided in the tool body 1 is a tape channel 10, which is connected to a tape magazine (not illustrated) and initially runs parallel to the longitudinal direction of the tool body, in order to pass through a bend of about 90° when approaching the front of the tool. Its inner wall 11 is led through as far as that point at which the tape closure 12 (FIG. 2) is in the ready-to-tie state. Its outer wall 34 ends further above at a distance from the point at 13. Mounted in or on the upper tongs part 3, at 14, is a rocker 15 whose width (transverse to the drawing plane) is no greater than the clear width of the tape channel 10 and which is impelled by spring force 16 into the tape channel 10. When the closure 12 is not in the position illustrated in FIG. 2, it is able to penetrate into the tape channel as far as its inner wall 11 in the last section of the tape channel 10, which is open following the end 13 of the outer wall 34. Its inner surface 17, which narrows the tape channel at an acute angle, then bounds the latter instead of the wall 34 on the outside. If the upper tongs part 3 is pivoted upwards for the purpose of opening the tongs (FIG. 1), the rocker 15 moves outwards under the influence of the end 13 of the outer wall 34 on its inner surface 17.

The tape channel 10 opens parallel to the front face of the tool body 1, inside the region enclosed by the wrapping tongs 2, 3, approximately parallel to the front of the tool body 1, at the point at which the tape closure 12 is located in the ready-to-tie state. Up to this point, it has a width which is suitable for the closure 12 to pass. It continues with a narrower width (transverse to the drawing plane), whilst forming steps 18 moving in laterally, in the shape of a groove 19 which is adjoined in alignment by a groove 20 contained in the lower tongs part 2. The said groove is continued by a corresponding groove 21 in the upper tongs part 3. The groove 21 finally ends at the point where, in the ready-to-tie position of the closure 12 (FIG. 2), its passage opening 22 is located. The opening 22 aligns with the end of the groove 21. The shoulders 18 are arranged such that they form a stop for the closure 12, in order to position the latter at this point. The shoulders 18 thus form a housing stop as a part of the closure holder, against which stop the closure 12 runs during its advancing movement.

The groove bottom of the groove 21 is not formed by the upper tongs part 3 at its end, but by the front face 23 of the rocker 15. This is cut out in steps at its corner adjacent to the closure 12, with the result that a front face 24 is formed which is seated behind the closure 12 when the latter is resting on the shoulders 18, as well as a retaining face 25 which, under the force of the spring 16, is seated on the rear margin of the closure 12, in order to press it against the inner wall 11. This part of the inner wall 11, and the stepped faces 24, 25 of the rocker, thus form the further parts of the closure holder, which determine the position of the closure 12 in the ready-to-tie position. The inner wall has a passage opening at the point of the closure opening 22.

The operating cycle of the tool comprises the following functional sequence. Firstly, the article to be tied, for example a cable harness, is inserted into the open wrapping tongs (FIG. 1). The tongs are closed by pivoting the upper tongs part 3 down, the rocker 15 penetrating into the tape channel 10 as far as the opposite wall 11. The tape, the free end of which is initially located, for example, at the position of the arrow 26, is advanced by a slider (not shown) in the tape channel 10. When its tip reaches the position of the arrow 27, it passes into the wedge gap between the inner wall 11 of the tape channel and the inner surface 17 of the rocker 15 and as a result is held in contact with the inner wall 11, while displacing the rocker 15 outwards a little. This imparts to the said tape an exactly reproducible position and advancing direction, with the result that it is ensured that, following the end of the tape channel 10, the tape correctly finds the entrance to the guide groove 20 of the lower tongs part 2, according to the arrow 28. As the advance continues, the advancing end of the tape is guided by the grooves 20, 21 around the article to be tied. When the closure 12 reaches its ready-to-tie position according to FIG. 2 and the advanced stops, the leading end has reached the position according to arrow 29. An inwardly directed pivoting movement of the lower tongs part 2 now begins, by means of which the circumference of the region enclosed by the wrapping tongs is reduced. Since the rear end of the tape in the shape of the closure 12 is firmly held in the closure holder, the free tape end is forced to pass through the opening 22 of the closure 12 in the direction of the arrow 30, until it is gripped by a tensioning device which is formed by a driven tensioning wheel 31 and two matching rollers 32, 33. The wrapping tongs 2, 3 can now be opened. At the same time, the closure holder also opens as a result of drawing the rocker 15 back. The latter is not needed for further functioning, since precise positioning of the closure 12 is no longer required for the tensioning operation which now follows. The free tape end projecting beyond the closure 12 is now cut off in a known way, as soon as a predetermined tape tension has been reached. This completes the tying operation.

I claim:

1. A tying tool for tying an article such as a cable harness with a tough elastic tape having a closure (12) arranged at the end of an elongated tape tongue comprising a tool body (1), wrapping tongs (2, 3) at the front on the tool body that can be opened and closed, the tool body having a tape guide channel (10) opening inside the wrapping tongs (2, 3) and having an advancing member for advancing the tape with the tape tongue forward, the wrapping tongs (2, 3) having a groove (20, 21) adjoining the tape guide channel (10) for guiding the tape around the article to be tied, a closure holder at the mouth of the tape guide channel (10) for holding the closure (12) and a spring rocker (15) for pressing the tape tongue being advanced along a surface (11) of the tape guide channel (10), the spring rocker (15) having a front face (24) that cooperates with the closure holder for holding the closure (12), at least one of the wrapping tongs being pivotable toward and away from a closed position and the rocker (15) being mounted on said pivotable wrapping tong.

2. The tying tool according to claim 1, characterized in that the rocker (15) projects into the tape channel (10) obliquely at an acute angle along the advance direction of the tape and includes spring means urging the rocker into the channel whereby the rocker can be displaced therefrom counter to the force of the spring means (16).

3. The tying tool according to claim 1, characterized in that the rocker (15) is mounted at the front side of the tape channel (10) at a distance from the closure holder (18, 11, 24).

4. The tying tool according to claim 1, characterized in that the rocker (15) has, adjacent to its front face (24) and cooperating with the closure holder, a retaining face (25) that engages the closure (12) on the side facing away from the tool body (1).

5. The tying tool according to claim 1, characterized in that the rocker includes a front guide face (23) running transversely with respect to the tape channel direction (10), said front guide face forming a continuation of the tape guide in the wrapping tongs (2, 3).

* * * * *